US011286952B2

(12) United States Patent
Mazur

(10) Patent No.: US 11,286,952 B2
(45) Date of Patent: Mar. 29, 2022

(54) DIFFUSION SYSTEM CONFIGURED FOR USE WITH CENTRIFUGAL COMPRESSOR

(71) Applicant: Rolls-Royce Corporation, Indianapolis, IN (US)

(72) Inventor: Steven Mazur, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 16/928,583

(22) Filed: Jul. 14, 2020

(65) Prior Publication Data

US 2022/0018361 A1 Jan. 20, 2022

(51) Int. Cl.
*F04D 29/44* (2006.01)

(52) U.S. Cl.
CPC ..... *F04D 29/444* (2013.01); *F05D 2220/32* (2013.01); *F05D 2240/12* (2013.01)

(58) Field of Classification Search
CPC ..... F04D 29/444
See application file for complete search history.

(56) References Cited

U.S. PATENT DOCUMENTS

| | | | | |
|---|---|---|---|---|
| 2,372,880 | A | 4/1945 | Browne | |
| 2,419,669 | A | 4/1947 | Rudolph | |
| 2,609,141 | A | 9/1952 | George | |
| 2,662,553 | A | 12/1953 | Albert | |
| 2,967,013 | A | 1/1961 | Frederick et al. | |
| 3,644,055 | A | 2/1972 | Davis | |
| 3,719,430 | A | 3/1973 | Blair et al. | |
| 3,860,360 | A | 1/1975 | Yu | |
| 3,861,826 | A | 1/1975 | Dean | |
| 3,876,328 | A | 4/1975 | Exley | |
| 3,905,721 | A | 9/1975 | Fitzpatrick | |
| 3,936,223 | A | 2/1976 | Baghdadi | |
| 3,997,281 | A * | 12/1976 | Atkinson | F04D 29/444 415/207 |
| 4,027,997 | A | 6/1977 | Bryans | |
| 4,100,732 | A | 7/1978 | Bryans et al. | |
| 4,344,737 | A | 8/1982 | Liu | |
| 4,349,314 | A | 9/1982 | Erwin | |
| 4,431,374 | A | 2/1984 | Benstein et al. | |
| 4,576,550 | A | 3/1986 | Bryans | |
| 4,824,325 | A | 4/1989 | Bandukwalla | |
| 4,877,373 | A | 10/1989 | Bandukwalla | |
| 4,938,661 | A | 7/1990 | Kobayashi et al. | |
| 5,178,516 | A | 1/1993 | Nakagawa et al. | |
| 5,316,441 | A | 5/1994 | Osborne | |
| 5,362,203 | A | 11/1994 | Brasz | |

(Continued)

FOREIGN PATENT DOCUMENTS

| | | |
|---|---|---|
| FR | 2922939 | 5/2009 |
| FR | 3024887 | 12/2018 |

(Continued)

*Primary Examiner* — Courtney D Heinle
*Assistant Examiner* — Ryan C Clark
(74) *Attorney, Agent, or Firm* — Barnes & Thornburg LLP

(57) ABSTRACT

A compressor includes an impeller and a diffuser. The impeller is mounted for rotation about an axis of the gas turbine engine. The diffuser is coupled to the impeller to receive the high velocity air from the impeller. The diffuser includes a first plate, a second plate spaced apart from the first plate axially, and a plurality of vanes located between the first and second plates.

19 Claims, 8 Drawing Sheets

(56) References Cited

U.S. PATENT DOCUMENTS

| | | | | |
|---|---|---|---|---|
| 5,564,898 | A | 10/1996 | Richards et al. | |
| 5,704,211 | A | 1/1998 | Hatfield | |
| 6,123,506 | A | 9/2000 | Brand et al. | |
| 6,155,779 | A | 12/2000 | Watanabe et al. | |
| 6,168,375 | B1 * | 1/2001 | LaRue | F04D 25/04 415/146 |
| 6,279,322 | B1 | 8/2001 | Moussa | |
| 6,442,940 | B1 | 9/2002 | Young et al. | |
| 6,471,475 | B1 | 10/2002 | Sasu et al. | |
| 6,540,481 | B2 | 4/2003 | Moussa et al. | |
| 6,554,569 | B2 | 4/2003 | Decker et al. | |
| 6,589,015 | B1 | 7/2003 | Roberts et al. | |
| 6,695,579 | B2 | 2/2004 | Meng | |
| 6,834,501 | B1 | 12/2004 | Vrbas et al. | |
| 7,025,566 | B2 | 4/2006 | Sasu et al. | |
| 7,032,383 | B2 | 4/2006 | Weber | |
| 7,094,024 | B2 | 8/2006 | Nguyen et al. | |
| 7,101,151 | B2 | 9/2006 | Loringer et al. | |
| 7,407,367 | B2 | 8/2008 | McAuliffe et al. | |
| 7,442,006 | B2 | 10/2008 | Nguyen et al. | |
| 7,448,852 | B2 | 11/2008 | Abdel et al. | |
| 7,500,364 | B2 | 3/2009 | Schumacher et al. | |
| 7,717,672 | B2 | 5/2010 | Barton et al. | |
| 7,798,777 | B2 | 9/2010 | Moussa et al. | |
| 7,827,798 | B2 | 11/2010 | Commaret et al. | |
| 7,862,295 | B2 | 1/2011 | Daguenet | |
| 7,871,243 | B2 | 1/2011 | Chen et al. | |
| 7,955,051 | B2 | 6/2011 | Daguenet et al. | |
| 8,006,497 | B2 | 8/2011 | Nolcheff et al. | |
| 8,016,557 | B2 | 9/2011 | Abdel et al. | |
| 8,038,392 | B2 | 10/2011 | Honda et al. | |
| 8,047,777 | B2 | 11/2011 | Commaret et al. | |
| 8,087,491 | B2 | 1/2012 | Merchant et al. | |
| 8,127,551 | B2 | 3/2012 | Commaret et al. | |
| 8,142,148 | B2 | 3/2012 | Hernandez et al. | |
| 8,147,186 | B2 | 4/2012 | Ibaraki et al. | |
| 8,162,604 | B2 | 4/2012 | Kuhnel et al. | |
| 8,231,341 | B2 | 7/2012 | Anderson et al. | |
| 8,287,236 | B2 | 10/2012 | Nishida et al. | |
| 8,425,188 | B2 | 4/2013 | Dovbush et al. | |
| 8,438,854 | B2 | 5/2013 | Nolcheff | |
| 8,505,305 | B2 | 8/2013 | Ziaei et al. | |
| 8,511,981 | B2 | 8/2013 | Small et al. | |
| 8,540,484 | B2 | 9/2013 | Hollman et al. | |
| 8,585,348 | B2 | 11/2013 | Lin et al. | |
| 8,602,728 | B2 | 12/2013 | Swiatek et al. | |
| 8,616,841 | B2 | 12/2013 | Johnson | |
| 8,616,843 | B2 | 12/2013 | Shibata et al. | |
| 8,839,625 | B2 | 9/2014 | Napier et al. | |
| 9,228,497 | B2 | 1/2016 | Ottow et al. | |
| 9,291,171 | B2 | 3/2016 | Bunel et al. | |
| 9,512,733 | B2 | 12/2016 | Lombard et al. | |
| 9,581,170 | B2 | 2/2017 | Holbrook | |
| 9,631,814 | B1 | 4/2017 | Barton et al. | |
| 9,726,032 | B2 | 8/2017 | Ress et al. | |
| 9,874,220 | B2 | 1/2018 | Adams | |
| 10,208,628 | B2 | 2/2019 | Nasir et al. | |
| 10,280,936 | B2 * | 5/2019 | Yoeda | F01D 9/026 |
| 10,330,121 | B2 | 6/2019 | Reynolds et al. | |
| 10,352,237 | B2 | 7/2019 | Mazur et al. | |
| 2005/0163610 | A1 | 7/2005 | Higashimori | |
| 2007/0183890 | A1 | 8/2007 | Nolcheff et al. | |
| 2010/0178163 | A1 * | 7/2010 | Dettmann | F04D 29/441 415/203 |
| 2012/0272663 | A1 | 11/2012 | Moussa et al. | |
| 2013/0224004 | A1 | 8/2013 | Radhakrishnam et al. | |
| 2014/0133957 | A1 | 5/2014 | Tarnowski et al. | |
| 2016/0003149 | A1 | 1/2016 | Suciu et al. | |
| 2016/0061212 | A1 | 3/2016 | Mokulys et al. | |
| 2016/0061219 | A1 | 3/2016 | Mokulys et al. | |
| 2016/0115971 | A1 | 4/2016 | Duong et al. | |
| 2017/0102005 | A1 | 4/2017 | Schuldt et al. | |
| 2017/0248155 | A1 | 8/2017 | Parker et al. | |
| 2017/0292536 | A1 | 10/2017 | Konig | |
| 2017/0342847 | A1 * | 11/2017 | Mazur | F02C 7/04 |
| 2017/0362947 | A1 | 12/2017 | Nasir et al. | |
| 2018/0135516 | A1 | 5/2018 | Nasir et al. | |
| 2018/0216629 | A1 | 8/2018 | Benetschik et al. | |
| 2018/0258959 | A1 | 9/2018 | Honda et al. | |
| 2018/0274376 | A1 | 9/2018 | King et al. | |
| 2018/0328381 | A1 * | 11/2018 | Parker | F04D 17/10 |
| 2019/0162191 | A1 | 5/2019 | Lesser et al. | |
| 2019/0226493 | A1 | 7/2019 | Choi et al. | |
| 2019/0264705 | A1 | 8/2019 | Higashimori et al. | |

FOREIGN PATENT DOCUMENTS

| | | |
|---|---|---|
| GB | 702773 A | 1/1954 |
| JP | 2010144698 | 7/2010 |
| WO | 2016001364 | 1/2016 |
| WO | 2017129342 | 8/2017 |
| WO | 2018205631 | 11/2018 |
| WO | 2019063384 | 4/2019 |

* cited by examiner

DIFFUSION SYSTEM CONFIGURED FOR USE WITH CENTRIFUGAL COMPRESSOR

FIELD OF THE DISCLOSURE

The present disclosure relates generally to gas turbine engines and more specifically to gas turbine engines with centrifugal compression.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors may include axial and centrifugal compression stages to compress the air drawn in to the engine. Centrifugal compressors use a rotating impeller device to increase kinetic energy in the flow path air and convert the kinetic energy into potential energy in the form of pressure as the impeller forces the air radially outward.

Centrifugal compressors may also include a diffuser that delivers air from the compressor to the combustor. The diffuser is located radially outward of the exit of the impeller to decelerate the air delivered from the impeller smoothly to recover static pressure.

SUMMARY

The present disclosure may comprise one or more of the following features and combinations thereof.

A diffuser adapted for use with a centrifugal compressor may include a first plate, a second plate, and a plurality of vanes. The first plate and the second plate may extend circumferentially about the axis. The second plate may be spaced apart axially from the first plate relative to the axis to define a flow path between the first plate and the second plate. The plurality of vanes may extend axially between and interconnect the first plate and the second plate.

In some embodiments, the plurality of vanes may include a first vane and a second vane. The second vane may be spaced apart circumferentially from the first vane to define a throat inlet of the diffuser. The throat inlet of the diffuser may be located at a radial throat distance from the axis.

In some embodiments, the first vane and the second vane may each include a leading edge and a trailing edge. The trailing edge may be spaced apart radially from the leading edge to define a camber line. The camber line may extend within the respective first and second vane and interconnect the leading edge and the trailing edge of the respective first and second vane.

In some embodiments, the plurality of vanes may be backswept such that the camber line of each of the first vane and the second vane is curved. At least one of the first plate and the second plate may diverge axially relative to the other of the first plate and the second plate beginning at a location equal to the radial throat distance or radially outward of the radial throat distance.

In some embodiments, both the first plate and the second plate may diverge axially away from the other of the first plate and the second plate as the first plate and the second plate extend radially outward relative to the axis. The first plate and the second plate may diverge linearly away from the other of the first plate and the second plate.

In some embodiments, each of the plurality of vanes may define a chord line between the leading edge and the trailing edge. The chord line may extend at an angle relative to a radial spoke line extending from the axis.

In some embodiments, the first plate may have a first segment and a second segment. The first segment may extend radially. The second segment may extend at an angle from the first segment.

In some embodiments, each of the plurality of vanes may include a pressure side and a suction side. The suction side may be opposite the pressure side.

In some embodiments, at least one of the pressure side and the suction side may include a concave surface. The concave surface may extend circumferentially into the respective vane and extend axially between and interconnect the first plate and the second plate.

In some embodiments, each of the plurality of vanes may include a pressure side and a suction side. The suction side may be opposite the pressure side.

In some embodiments, the pressure side and the suction side may each include a concave surface. The concave surface may extend circumferentially into the respective vane and extend axially between and interconnect the first plate and the second plate.

In some embodiments, the first vane and the second vane of the plurality of vanes may define a throat exit. The throat exit may be spaced apart from the throat inlet. The throat exit may have a throat exit are. The throat exit area may be greater than a throat inlet area of the throat inlet.

In some embodiments, each of the plurality of vanes may define a chord line. The chord line may extend linearly a chord-line distance between and interconnect the leading edge and the trailing edge.

In some embodiments, the camber line may be curved relative to the chord line to define a maximum camber-line height between the camber line and the chord line. The camber-line height may be equal to or less than about one to ten percent of the chord-line distance.

In some embodiments, a first line tangent to the leading edge of the first vane and a first radial spoke from the axis extending to the leading edge may define a first angle. In some embodiments, a second line tangent to the trailing edge of the first vane and a second spoke from the axis extending to the trailing edge may define a second angle. A difference between the first angle and the second angle may be about 15 degrees.

In some embodiments, the at least one of the first plate and the second plate may diverge away from a radial plane of the axis at a divergence angle. The divergence angle may be about 5 degrees.

According to another aspect of the present disclosure, a diffuser adapted for use with a centrifugal compressor may include a first plate, a second plate, a first vane, and a second vane. The first plate and the second plate may extend circumferentially about the axis. The second plate may be spaced apart axially from the first plate relative to the axis. The second vane may be spaced apart circumferentially from the first vane.

In some embodiments, the first vane may have a first camber line and the second vane may have a second camber line. The first camber line may extend between and interconnect a leading edge and a trailing edge of the first vane.

The second camber line may extend between and interconnect a leading edge and a trailing edge of the second vane.

In some embodiments, the first camber line and the second camber line may be curved. The first plate and the second plate may cooperate to define a flowpath that diverges axially as the first plate and the second plate extend radially outward relative to the axis.

In some embodiments, the first vane and the second vane may define a throat inlet of the diffuser. The throat inlet of the diffuser may be located at a radial throat distance from the axis. The flowpath may diverge axially beginning at a location equal to or radially outward of the radial throat distance.

In some embodiments, both the first plate and the second plate may diverge axially away from each other as the first plate and the second plate extend radially outward relative to the axis. The first plate and the second plate may diverge linearly away from each other.

In some embodiments, the first vane may define a chord line. The chord line may extend linearly a chord-line distance between and interconnect the leading edge and the trailing edge of the first vane.

In some embodiments, the camber line of the first vane may be curved relative to the chord line to define a maximum camber-line height between the camber line and the chord line of the first vane. The camber-line height may be equal to or less than about two percent of the chord-line distance.

In some embodiments, the first vane may extend circumferentially away from the axis at a first angle relative to a first radial spoke of the axis at the leading edge. The first vane may extend circumferentially away from the axis at a second angle relative to a second radial spoke of the axis at the trailing edge. The difference between the first angle and the second angle may be about 15 degrees.

In some embodiments, the flowpath may diverge axially as the first plate and the second plate extend radially outward relative to the axis between at an angle of between about 1 degree and about 10 degrees. In some embodiments, the angle may be about 5 degrees.

In some embodiments, the first vane may include a first side and a second side. The second side may be spaced apart circumferentially from the first side.

In some embodiments, at least one of the first side and the second side defines a concave shape. The concave shape may extend circumferentially into the first vane.

These and other features of the present disclosure will become more apparent from the following description of the illustrative embodiments.

DETAILED DESCRIPTION OF THE DRAWINGS

Figure 1:
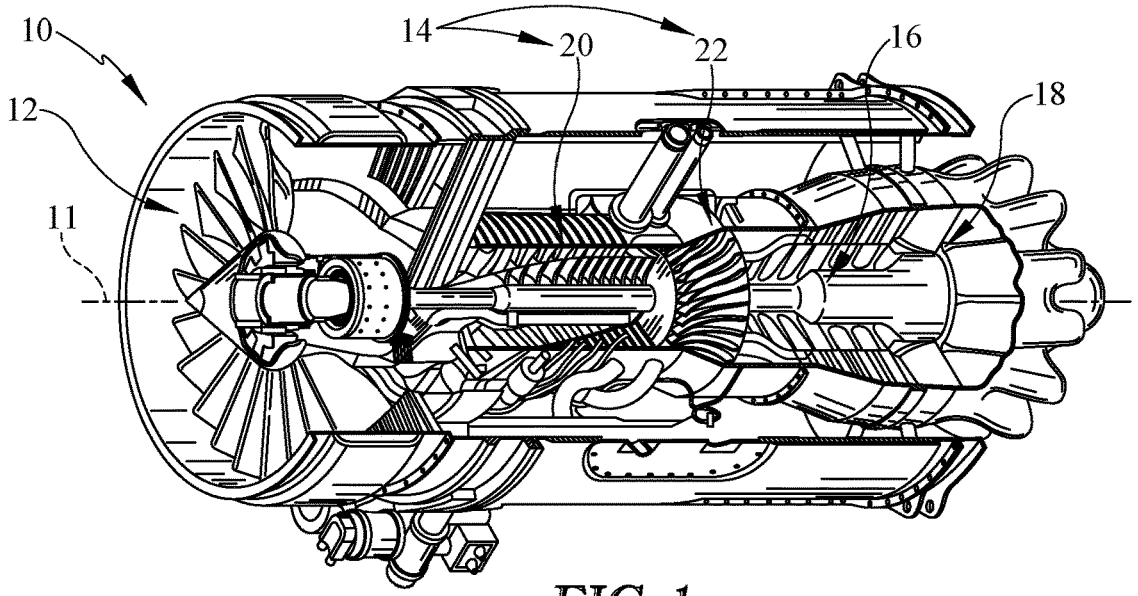
FIG. 1 is a cut away perspective view of a gas turbine engine showing the engine includes a fan, an axi-centrifugal compressor, a combustor fluidly coupled to the compressor, and a turbine fluidly coupled to the combustor.

For the purposes of promoting an understanding of the principles of the disclosure, reference will now be made to a number of illustrative embodiments illustrated in the drawings and specific language will be used to describe the same.

An illustrative gas turbine engine 10 includes a fan 12, an axi-centrifugal compressor 14, a combustor 16 fluidly coupled to the compressor 14, and a turbine 18 fluidly coupled to the combustor 16 as shown in FIG. 1. The fan 12 is driven by the turbine 18 and provides thrust for propelling an aircraft. The compressor 14 compresses gases and delivers the compressed gases to the combustor 16. The combustor 16 mixes fuel with the compressed gases and ignites the fuel to produce hot, high pressure combustion products. The hot, high pressure combustion products of the combustion reaction in the combustor 16 are directed into the turbine 18 to cause the turbine 18 to rotate about an axis 11 of the gas turbine engine 10. The turbine 18 extracts mechanical work from the hot, high pressure combustion products to drive the compressor 14 and the fan 12. In other embodiments, a drive shaft or propeller may be powered by the turbine 18 in place of the fan 12.

Figure 2:
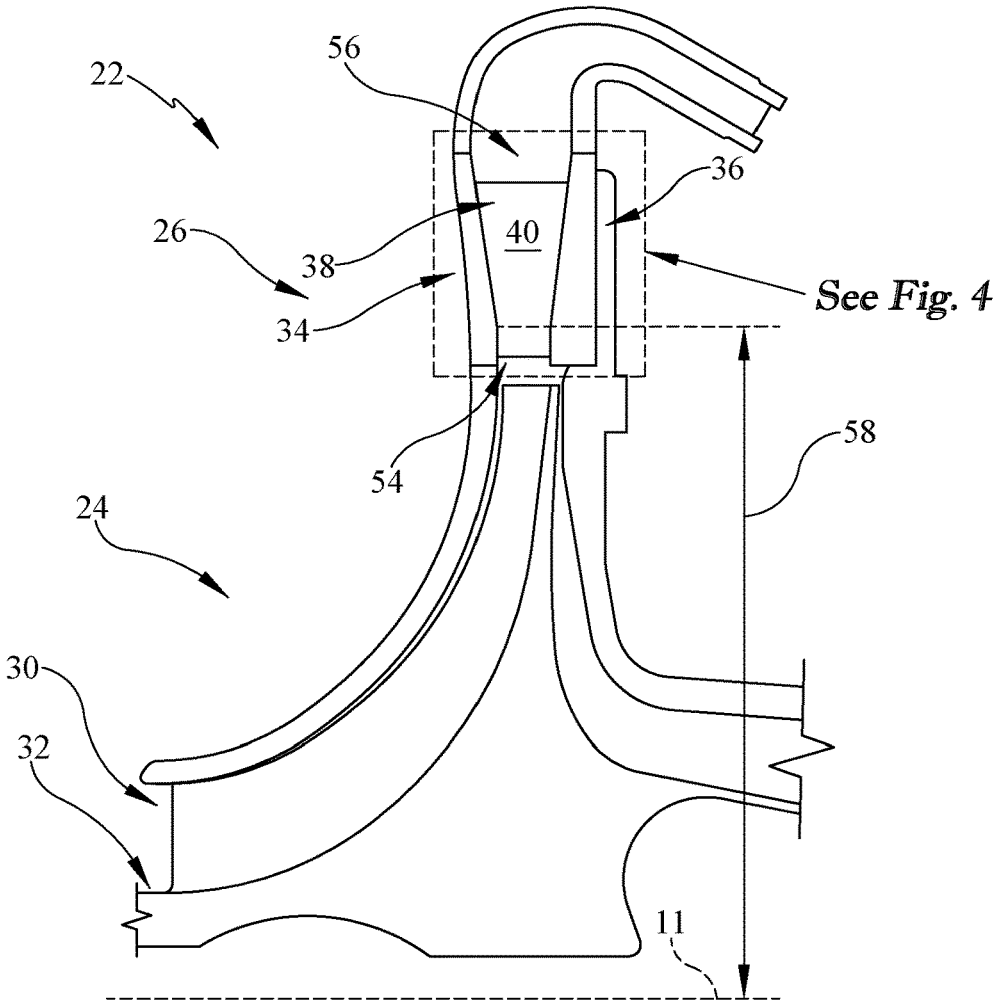
FIG. 2 is a cross-section view of the gas turbine engine of FIG. 1 showing the axi-centrifugal compressor includes a centrifugal compressor having an impeller mounted for rotation about an axis of the gas turbine engine and a diffuser configured to receive the high velocity air from the impeller, the diffuser including a fore plate, an aft plate, and vanes that extend axially between the fore and aft plates.
Figure 3:
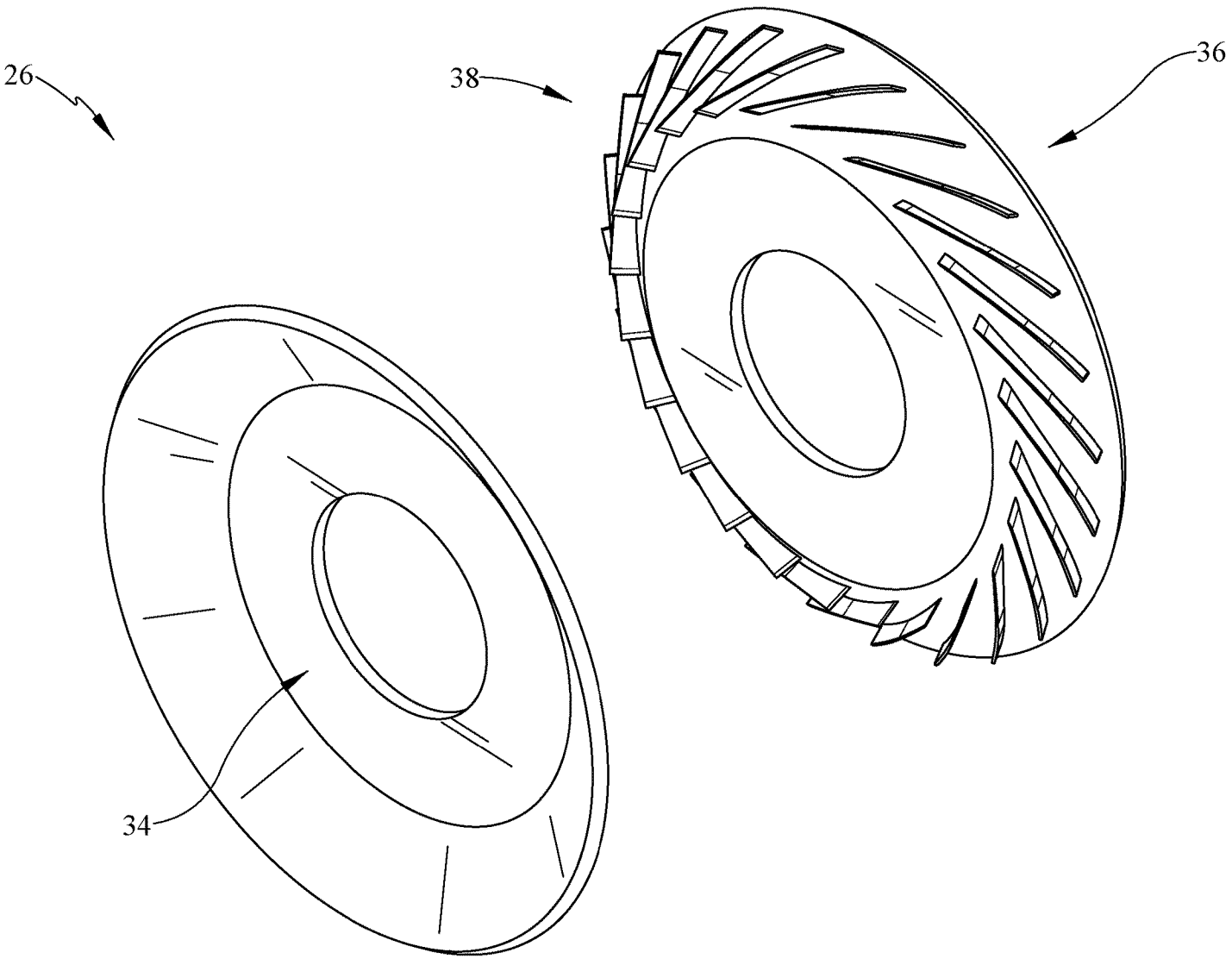
FIG. 3 is an exploded view of the diffuser of FIG. 2 showing the plurality of vanes are spaced apart circumferentially about the axis and are backswept such that a camber line of each vane is curved and suggesting the fore plate is formed to diverge away from the aft plate at the radial outer end of the fore plate.

The axi-centrifugal compressor 14 has axial compression stages 20 and a centrifugal compression stage 22 as shown in FIG. 1. The axial compression stages 20 include a plurality of bladed rotatable wheels located between vane wheels. The centrifugal compression stage 22 includes an impeller 24 and a diffuser 26 as shown in FIG. 2. The impeller 24 is mounted for rotation about the axis 11 and formed to have impeller blades 30 that each extend from an impeller disk 32. The diffuser 26 is coupled to the impeller 24 to receive the compressed gases from the impeller 24 and discharge the compressed gases to the combustor 16. In some embodiments, a deswirler is located fluidly between the diffuser 26 and the combustor 16.

The diffuser 26 includes a first plate 34, a second plate 36, and a plurality of vanes 38 as shown in FIGS. 2-4 and 9. The first plate 34 and the second plate 36 each extend circumferentially about the axis 11. The second plate 36 is spaced apart axially from the first plate 34 to define a flow path 40 therebetween. In the illustrative embodiment, the second, or aft plate 36 is spaced axially aft from the first, or fore plate 34 to define the flow path 40. The plurality of vanes 38 extend axially between and interconnect the fore plate 34 and the aft plate 36.

Figure 4:
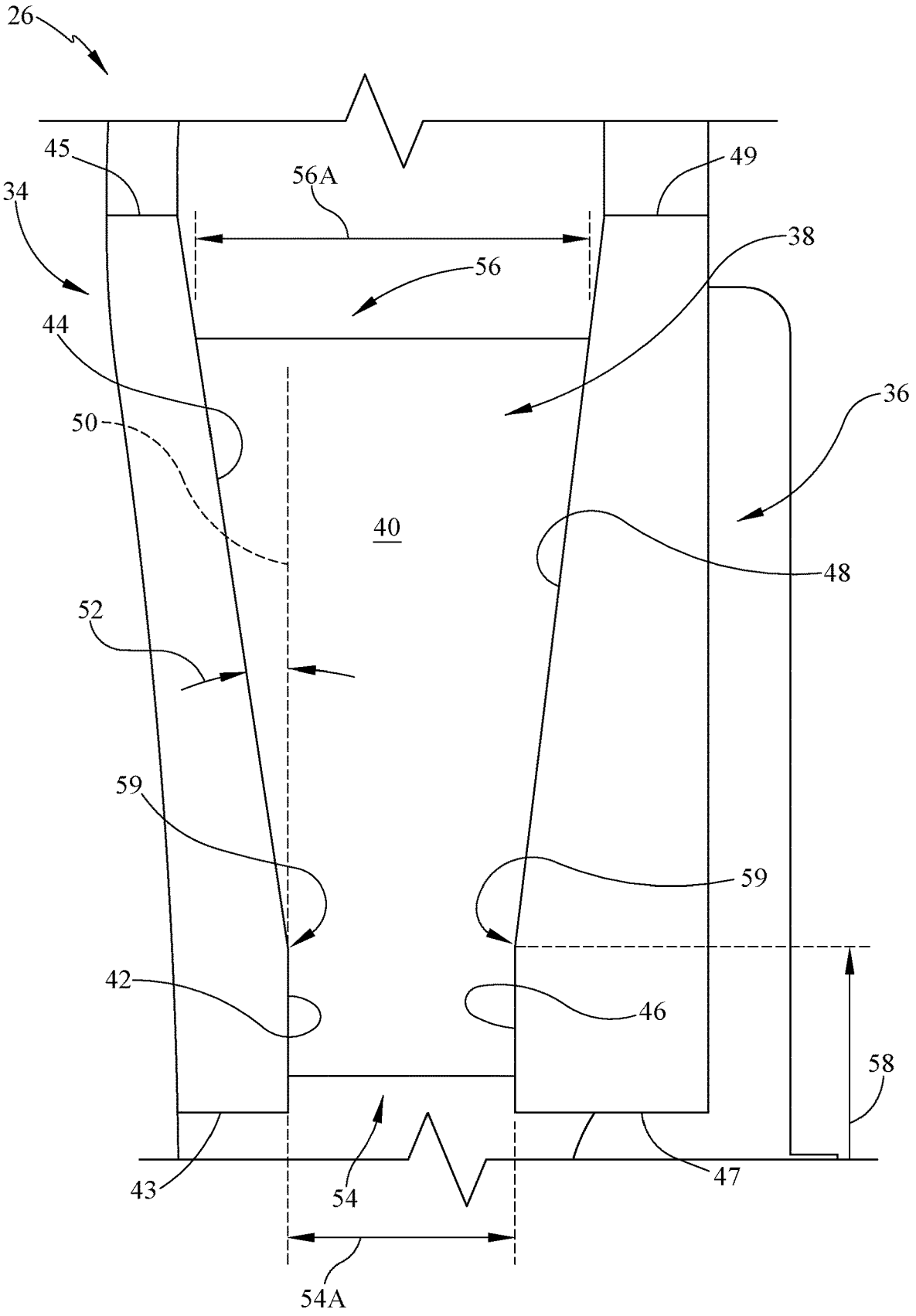
FIG. 4 is a detailed cross-section view of FIG. 2 showing the fore plate and the aft plate diverge away from one another as the plates extend radially outward relative to the axis.
Figure 7:
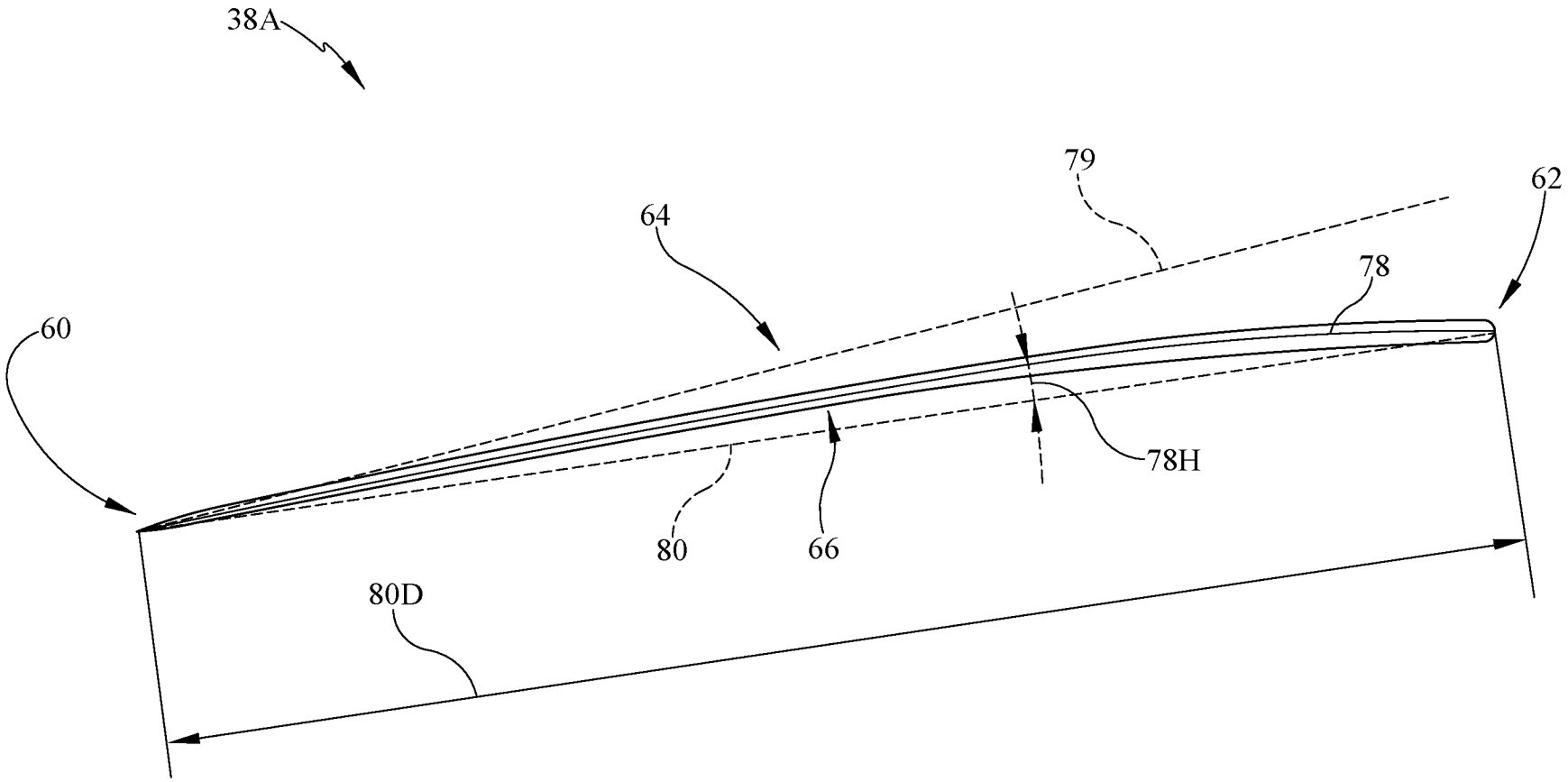
FIG. 7 is an elevation view of one of the plurality of vanes of FIG. 5 showing the vane defines a camber line that extends within the vane and interconnects leading and trailing edges of the vane and showing the camber line is curved relative to a chord line because the vane is backswept to define a maximum camber-line height between the camber line and the chord line.

The fore plate 34 and aft plate 36 diverge axially away from each other as the fore plate 34 and aft plate 36 extend radially outward relative to the axis 11 as shown in FIGS. 2 and 4. By diverging the front and aft plates 34, 36, the radial velocity of the compressed gases may be reduced as compared to a compressor that does not have diverging plate. The diverging plates 34, 36 may also increase the swirl of the flow of compressed gases. The vanes 38 are backswept such that a camber line 78 of each vane 38 is curved as shown in FIG. 7 which may increase the velocity as compared to a compressor that does not have backswept vanes. As such, the overall performance of the diffuser 26 and the state of the air exiting the diffuser remains relatively unchanged as compared to a non-diverging and non-backswept diffuser, but allows for the radial space claim of the diffuser 26 to be reduced. In other words, the diffuser 26 is relatively longer axially, but smaller radially. An engine with a smaller radial height may be more desirable for some applications, less expensive to manufacture, and/or perform better, for example, due to weight reduction, even if the axial length is increased.

In a typical diffuser, the camber line 79 is straight as suggested in FIG. 7. In the illustrative embodiment, the camber line 78 is curved or backswept diverging from the typically straight camber line 79. Backsweeping the vanes 38 may keep the flow of compressed gases aligned with the vanes 38 and attached to the surfaces 68, 70 of each vane 38. The combination of the diverging plates 34, 36 and the backswept vanes 38 may improve the diffuser area ratio in the same radial space envelope.

In the illustrative embodiment, each of the fore and aft plates 34, 36 includes a terminal ends 43, 45, 47, 49, a first segment 42, 46, and a second segment 44, 48 as shown in FIG. 4. The first segment 42, 46 extends radially outward from an inner terminal end 43, 47 of the plate 34, 36 that confronts a portion of the impeller 24 at the outlet of the impeller 24. The second segment 44, 48 extends from the first segment 42, 46 and terminates at an outer terminal end 45, 49.

The first segment 42, 46 extends radially along a radial plane 50 of the axis 11, while the second segment 44, 48 extends at an angle 52 from the first segment 42, 46. In the illustrative embodiment, the second segments 44, 48 of the fore and aft plates 34, 36 diverge linearly away from the other.

The outer terminal end 45, 49 are spaced apart radially from the respective terminal end 43, 47. The location 59 at which the fore and aft plates 34, 36 begin to diverge is spaced radially outward of the inner terminal end 43, 47 of the respective plate 34, 36.

Both the fore plate 34 and the aft plate 36 diverge away from the radial plane 50 of the axis 11 at a divergence angle 52 of about 5 degrees in the illustrative embodiment. In some embodiments, the divergence angle 52 is about 10 degrees. In other embodiments, the divergence angle 52 is between about 1 degree and about 10 degrees.

In some embodiments, the divergence angle 52 is between about 1 degree and about 9 degrees. In some embodiments, the divergence angle 52 is between about 1 degree and about 8 degrees. In some embodiments, the divergence angle 52 is between about 1 degree and about 7 degrees. In some embodiments, the divergence angle 52 is between about 1 degree and about 6 degrees. In some embodiments, the divergence angle 52 is between about 1 degree and about 5 degrees.

In some embodiments, the divergence angle 52 is between about 5 degrees and about 10 degrees. In some embodiments, the divergence angle 52 is between about 4 degrees and about 10 degrees. In some embodiments, the divergence angle 52 is between about 3 degrees and about 10 degrees. In some embodiments, the divergence angle 52 is between about 2 degrees and about 10 degrees.

In some embodiments, the divergence angle 52 is between about 6 degrees and about 10 degrees. In some embodiments, the divergence angle 52 is between about 7 degrees and about 10 degrees. In some embodiments, the divergence angle 52 is between about 8 degrees and about 10 degrees.

In the illustrative embodiments, the divergence angle 52 of the fore plate 34 is the same as the divergence angle 52 of the aft plate 36. In other embodiments, the divergence angle 52 of the fore plate 34 may be different from the divergence angle 52 of the aft plate 36. In some embodiments, the divergence angle 52 of the fore plate 34 relative to the radial plane 50 is greater than the divergence angle 52 of the aft plate 36. In other embodiments, the divergence angle 52 of the fore plate 34 relative to the radial plane 50 is less than the divergence angle 52 of the aft plate 36.

Figure 5:
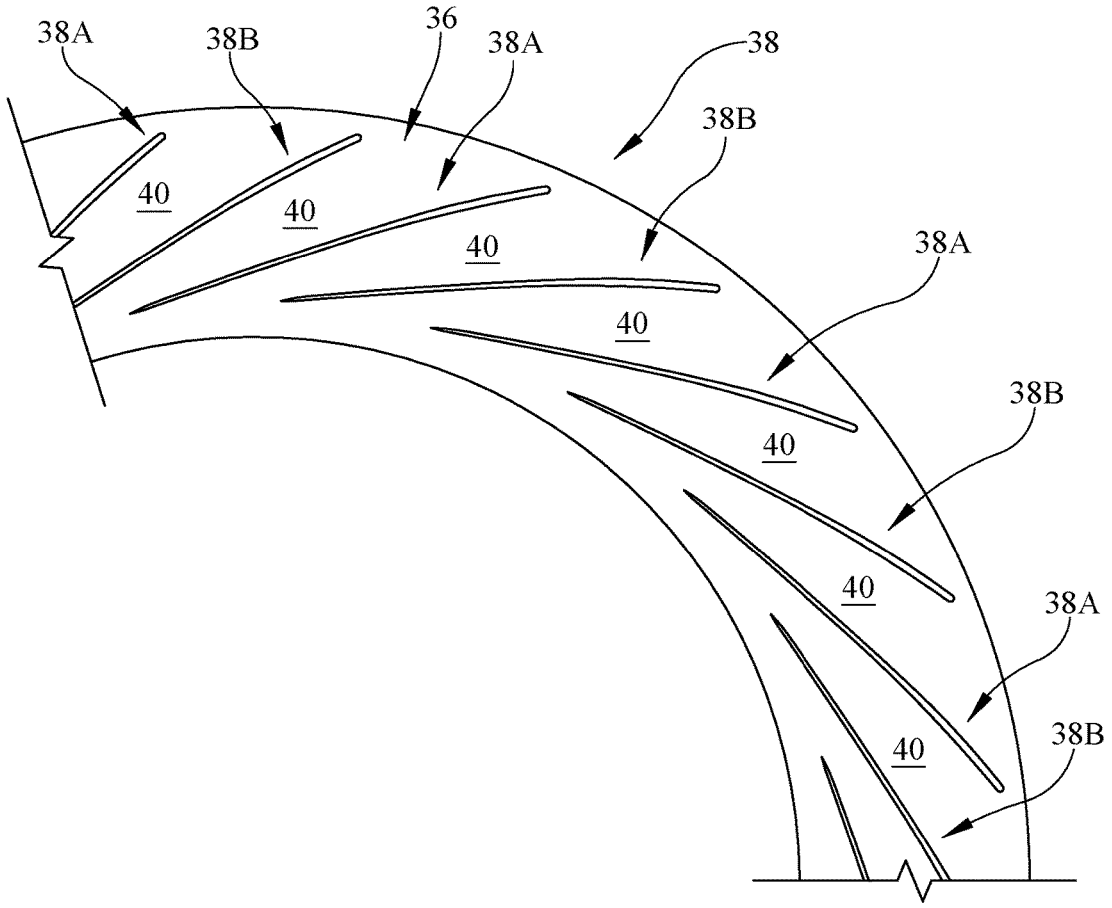
FIG. 5 is an elevation view of a portion of the diffuser of FIG. 2 showing the plurality of vanes are spaced apart circumferentially from each other to define a flow path therebetween.
Figure 6:
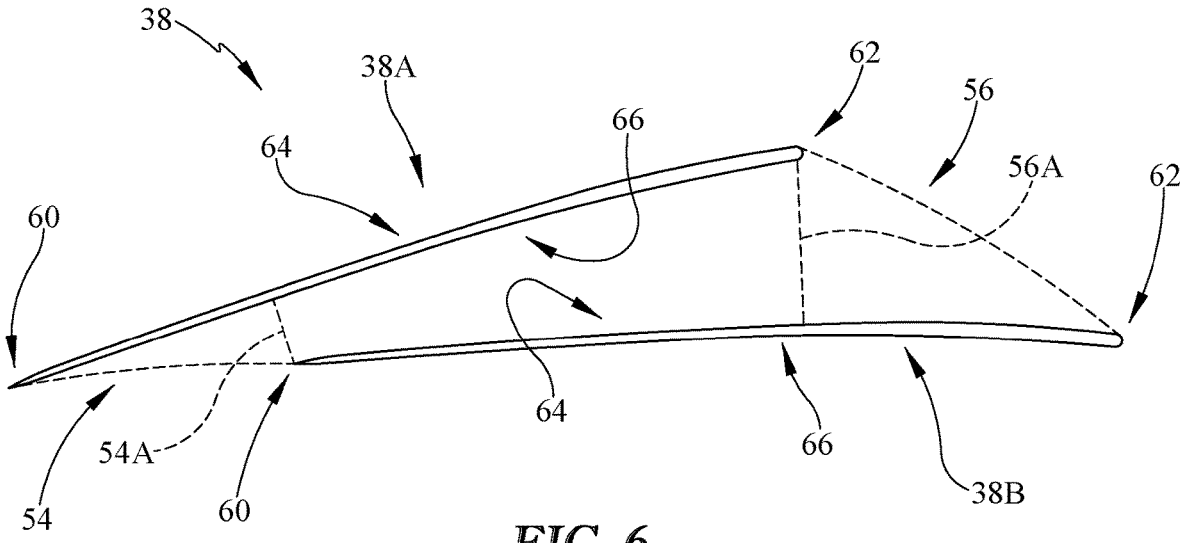
FIG. 6 is a detail view of FIG. 5 showing a throat inlet and a throat exit defined between a first vane and a second vane included in the plurality of vanes.
Figure 9:
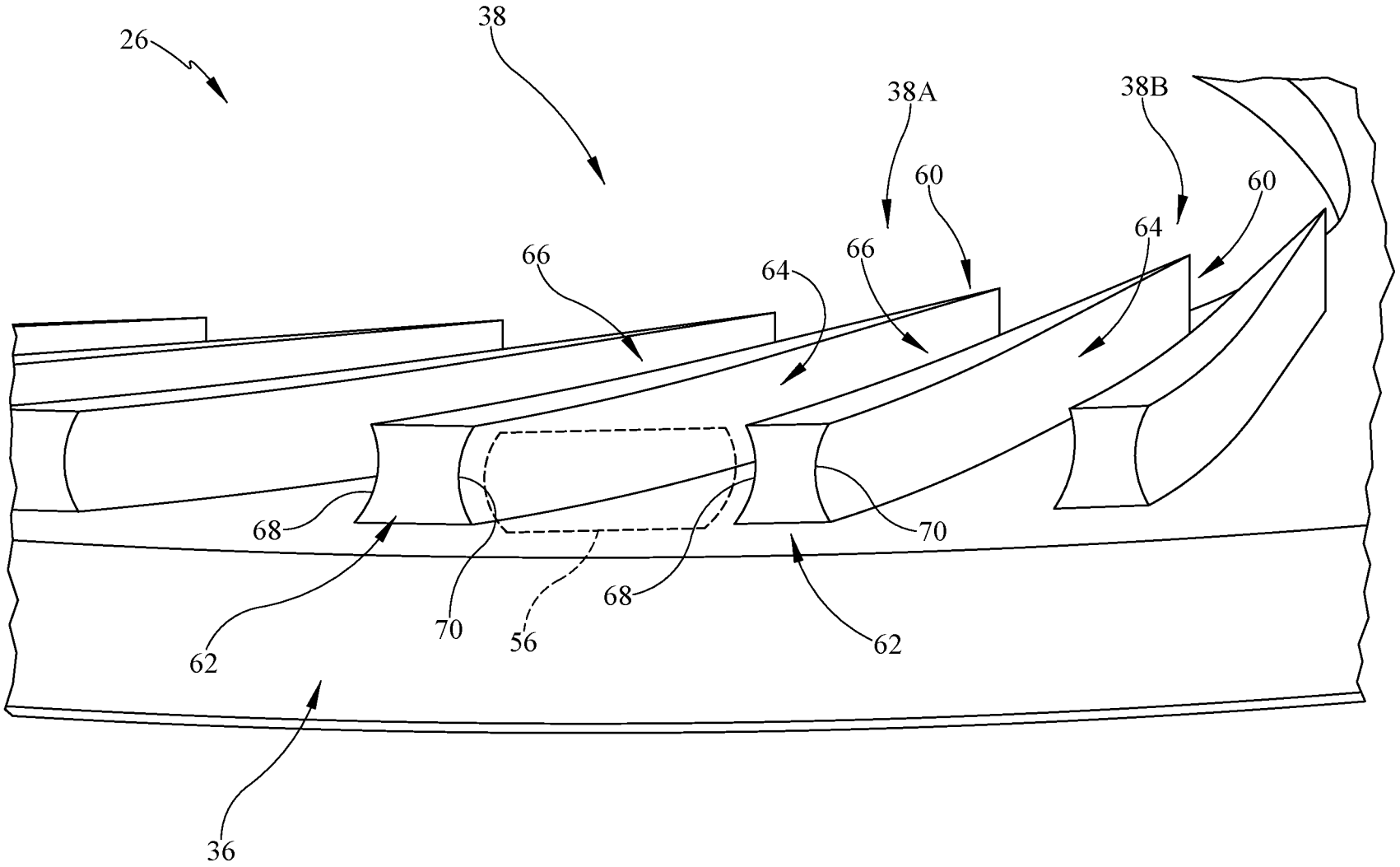
FIG. 9 is a perspective view of diffuser of FIG. 2 showing the plurality of vanes each include a pressure side and a suction side opposite the pressure side that each have a concave surface that extends circumferentially into the respective vane and extends axially between and interconnects the fore plate and the aft plate.

Turning again to the plurality of vanes, the plurality of vanes 38 includes a first vane 38A and a second vane 38B as shown in FIGS. 5, 6, and 9. The second vane 38B is spaced apart circumferentially from the first vane 38A to define a throat inlet 54 and a throat exit 56 of the diffuser 26. The throat inlet 54 is located at a radial throat distance 58 from the axis 11 as shown in FIGS. 2 and 4. The throat exit 56 is spaced apart from the throat inlet 54 and has a throat exit area 56A that is greater than a throat inlet area 54A of the throat inlet 54.

In the illustrative embodiment, the front and aft plates 34, 36 diverge away from each other at a location 59 equal to the radial throat distance 58 as shown in FIG. 4. In other embodiments, the front and aft plates 34, 36 diverge away from each other beginning at a location 59 radially outward of the radial throat distance 58.

The front and aft plates 34, 36 diverge away from each other beginning at the location 59 equal to or radially outward of the radial throat distance 58 so as to keep the flow of compressed gases stable. If the front and aft plates 34, 36 were to diverge before the throat inlet 54 of the vanes 38, the flow of compressed gases may be disrupted resulting in pressure fluctuations within the diffuser 26, which may cause the compressor 15 to stall. Therefore, the front and aft plates 34, 36 are configured to begin diverging away from each other at the location 59 radially outward of the throat inlet 54 to keep the flow of compressed gases stable through the throat inlet 54 so as to minimize unstable flow and possible stalling in the compressor 15.

Each of the vanes 38 includes a leading edge 60, a trailing edge 62, a pressure side 64, and a suction side 66 opposite the pressure side 64 as shown in FIGS. 6-9. The trailing edge 62 is spaced apart radially from the leading edge 60 to define the camber line 78. The camber line 78 extends within the respective vane 38 and interconnects the leading edge 60 and the trailing edge 62 of the respective vane 38.

In the illustrative embodiment, the pressure side 64 and suction side 66 each include a concave surface 68, 70 as shown in FIG. 9. Each concave surface 68, 70 on the respective side 64, 66 of the vane 38 extends circumferentially into the respective vane 38 and extends axially between and interconnects the fore and aft plates 34, 36.

In some embodiments, the curvature of the concave surface 68, 70 may vary as the corresponding side 64, 66 extends from the leading edge 60 to the trailing edge 62. The depth of the curvature of the concave surface 68, 70 may vary from the leading edge 60 to the trailing edge 62. Portions of the pressure side 64 and suction side 66 located closer to the leading edge 60 may have a smaller curve depth than the curve depth of portions of the pressure side 64 and suction side 66 located closer to the trailing edge 62. In some embodiments, the curve depth of the concave surface 68 of the pressure side 64 may be different from the curve depth of the concave surface 70 of the suction side 66.

In other embodiments, only the pressure side 64 includes the concave surface 68, while the surface 70 on the suction side 66 is flat. In other embodiments, only the suction side 66 include the concave surface 70, while the surface 68 on the pressure side 64 is flat.

Each of the vanes 38 also defines a chord line 80 as shown in FIG. 7. The chord line 80 extends linearly a chord-line distance 80D between the leading edge 60 and the trailing edge 62. The chord line 80 extends at an angle 86 relative to an imaginary radial spoke line 74 extending from the axis 11.

In the illustrative embodiment, the camber line 78 is curved relative to the chord line 80 as shown in FIG. 7. The camber line 78 is curved relative to the chord line 80 to define a maximum camber-line height 78H between the camber line 78 and the chord line 80.

The camber-line height 78H is equal to or less than about two percent of the chord-line distance 80D in the illustrative embodiment. In other embodiments, the camber-line height 78H is between about one percent and about ten percent. In other embodiments, the camber-line height 78H is between about two percent and about three percent.

In some embodiments, the camber-line height 78H is between about one percent and about three percent. In some embodiments, the camber-line height 78H is between about one percent and about four percent. In some embodiments, the camber-line height 78H is between about one percent and about five percent.

In some embodiments, the camber-line height 78H is between about two percent and about five percent. In some embodiments, the camber-line height 78H is between about two percent and about ten percent.

In some embodiments, the camber-line height 78H is between about two percent and about six percent. In some embodiments, the camber-line height 78H is between about two percent and about seven percent. In some embodiments, the camber-line height 78H is between about two percent and about eight percent.

Figure 8:
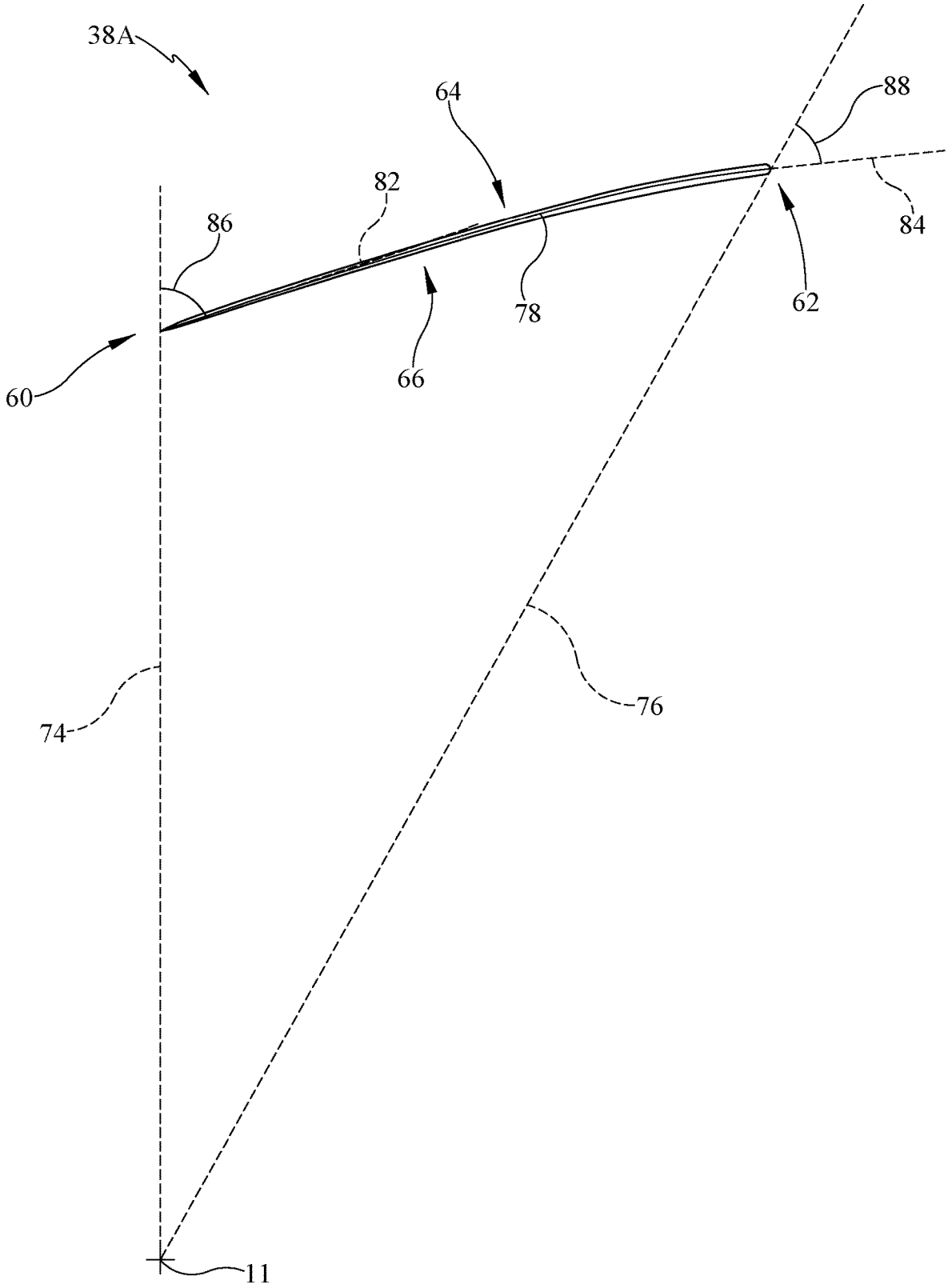
FIG. 8 is an elevation view of one of the plurality of vanes of FIG. 5 showing a first line tangent to the leading edge of the first vane and a first radial spoke from the axis extending to the leading edge define a first angle and showing a second line tangent to the trailing edge of the first vane and a second spoke from the axis extending to the trailing edge define a second angle.

In the illustrative embodiment, the first imaginary radial spoke 74 extends from the axis 11 to the leading edge 60 of the corresponding vane 38, while a second imaginary radial spoke 76 extends from the axis 11 to the trailing edge 62 of the corresponding vane 38 as shown in FIG. 8. A first line 82 tangent to the leading edge 60 of the vane 38 and the first radial spoke 74 define the first angle 86. A second line 84 tangent to the trailing edge 62 of the vane 38 and the second radial spoke 76 define a second angle 88.

In the illustrative embodiment, the vanes 38 are back-swept such that there is a difference between the first angle 86 and the second angle 88. The difference between the first angle 86 and the second angle 88 is about 15 degrees in the illustrative embodiment. In some embodiments, the difference between the first angle 86 and the second angle 88 may be between about two degrees and about 15 degrees. In some embodiments, the difference between the first angle 86 and the second angle 88 may be between about 5 degrees and about 15 degrees. In other embodiments, the difference between the first angle 86 and the second angle 88 may be about 5 degrees.

In some embodiments, the difference between the first angle 86 and the second angle 88 may be between about two degrees and about 10 degrees. In some embodiments, the difference between the first angle 86 and the second angle 88 may be between about two degrees and about 5 degrees.

In some embodiments, the difference between the first angle 86 and the second angle 88 may be between about 5 degrees and about 10 degrees. In some embodiments, the difference between the first angle 86 and the second angle 88 may be between about 10 degrees and about 15 degrees.

In some embodiments, the difference between the first angle 86 and the second angle 88 may be between about two degrees and about 9 degrees. In some embodiments, the difference between the first angle 86 and the second angle 88 may be between about two degrees and about 8 degrees. In some embodiments, the difference between the first angle 86 and the second angle 88 may be between about two degrees and about 7 degrees.

In some embodiments, the difference between the first angle 86 and the second angle 88 may be between about two degrees and about 6 degrees. In some embodiments, the difference between the first angle 86 and the second angle 88 may be between about two degrees and about 4 degrees.

In some embodiments, the difference between the first angle 86 and the second angle 88 may be between about 3 degrees and about 10 degrees. In some embodiments, the difference between the first angle 86 and the second angle 88 may be between about 4 degrees and about 10 degrees.

In some embodiments, the difference between the first angle 86 and the second angle 88 may be between about 6 degrees and about 10 degrees. In some embodiments, the difference between the first angle 86 and the second angle 88 may be between about 7 degrees and about 10 degrees.

Figure 10:
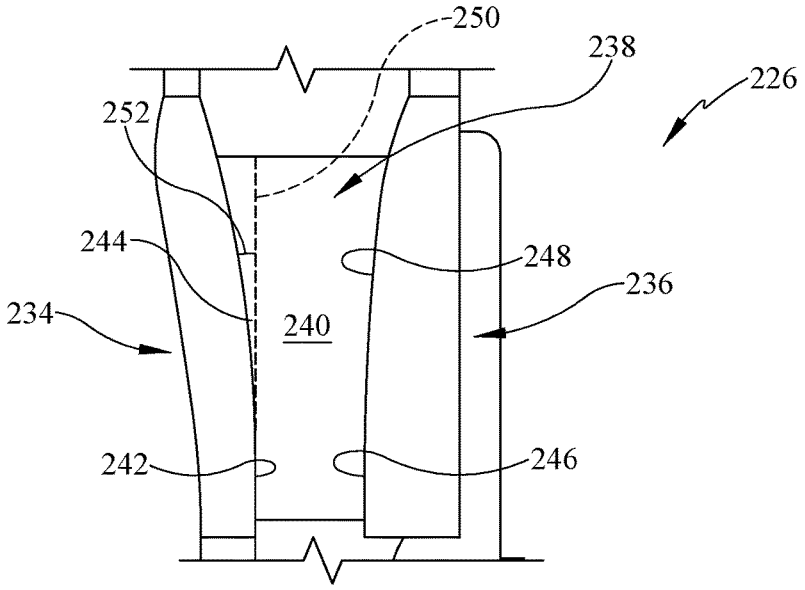
FIG. 10 is a cross-sectional view of another embodiment of a diffuser adapted for use in the centrifugal compressor included in the gas turbine engine of FIG. 1 showing the diffuser includes a fore plate, an aft plate spaced apart axially from the fore plate, and vanes that extend axially between and interconnect the fore plate and the aft plate, and further showing the fore and aft plates are curved such that both plates diverge non-linearly away from each other moving radially outward relative to the axis.

Another embodiment of a diffuser 226 in accordance with the present disclosure is shown in FIG. 10. The diffuser 226 is substantially similar to the diffuser 26 shown in FIGS. 1-9 and described herein. Accordingly, similar reference numbers in the 200 series indicate features that are common between the diffuser 226 and the diffuser 26. The description of the diffuser 26 is incorporated by reference to apply to the diffuser 226, except in instances when it conflicts with the specific description and the drawings of the diffuser 226.

The diffuser 226 includes a fore plate 234, an aft plate 236, and vanes 238 as shown in FIG. 10. The fore plate 234 and the aft plate 236 each extend circumferentially about the axis 11. The aft plate 236 is spaced apart axially from the fore plate 234 to define a flow path 240 therebetween. Each of the vanes 238 extend axially between and interconnect the fore plate 234 and the aft plate 236.

The fore plate 234 and aft plate 236 diverge axially away from each other as the fore plate 234 and aft plate 236 extend radially outward relative to the axis 11 as shown in FIG. 10. The fore and aft plates 234, 236 diverge non-linearly away from each other in the illustrative embodiment. Both the fore and aft plates 234, 236 curve away from each other as the plates 234, 236 extends radially outward relative to the axis 11.

Each of the fore and aft plates 234, 236 includes a first segment 242, 246 and a second segment 244, 248 as shown in FIG. 10. The first segment 242, 246 extends radially along a radial plane 250 of the axis 11, while the second segment 244, 248 extends at an angle 252 from the first segment 242, 246.

In the illustrative embodiment, the second segments 244, 248 of the fore and aft plates 234, 236 are curved relative to the first segment 242, 246. As such, the angle 252 between the second segments 244, 248 and the radial plane 250 increases as the plates 234, 236 extend radially outward.

In the illustrative embodiment, the front and aft plates 234, 236 diverge away from each other beginning at the location 59 equal to the radial throat distance 58 as shown in FIG. 4. In other embodiments, the front and aft plates 234, 236 diverge away from each other at the location 59 radially outward of the radial throat distance 58.

In the illustrative embodiments, the curvature of the fore plate 234 is the same as the curvature of the aft plate 236. In other words, the front and aft plates 234, 236 diverge along the same non-linear path. In other embodiments, the curvature of the fore plate 234 may be different from the curvature of the aft plate 236.

In some embodiments, the curvature of the fore plate 234 relative to the radial plane 250 is greater than the curvature of the aft plate 236. In other embodiments, the curvature of the fore plate 234 relative to the radial plane 250 is less than the curvature of the aft plate 236.

In some embodiments, the fore plate 234 may be curved, while the aft plate 236 may diverge linearly. In other embodiments, the fore plate 234 may be linear, while the aft plate 236 may be curved.

Figure 11:
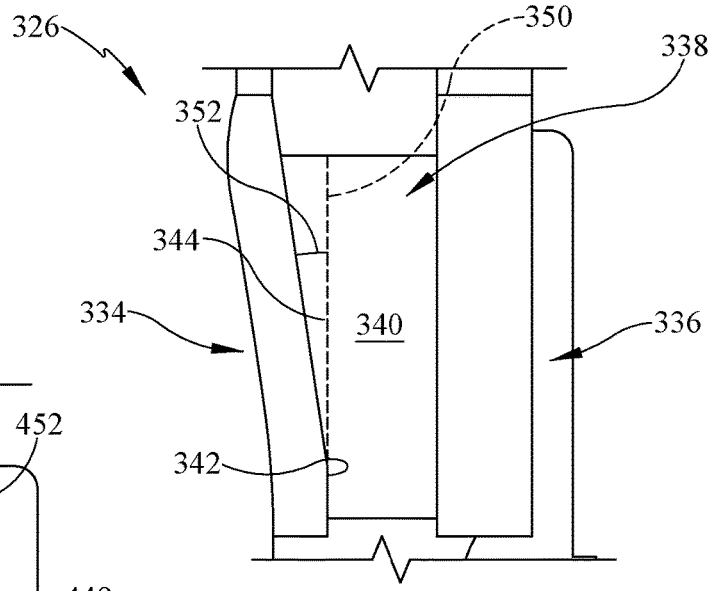
FIG. 11 is a cross-sectional view of another embodiment of a diffuser adapted for use in the centrifugal compressor included in the gas turbine engine of FIG. 1 showing that the aft plate extends radially and the fore plate diverges away from the aft plate as the plates extend radially outward.

Another embodiment of a diffuser 326 in accordance with the present disclosure is shown in FIG. 11. The diffuser 326 is substantially similar to the diffuser 26 shown in FIGS. 1-9 and described herein. Accordingly, similar reference numbers in the 300 series indicate features that are common between the diffuser 326 and the diffuser 26. The description of the diffuser 26 is incorporated by reference to apply to the diffuser 326, except in instances when it conflicts with the specific description and the drawings of the diffuser 326.

The diffuser 326 includes a fore plate 334, an aft plate 336, and a plurality of vanes 338 as shown in FIG. 11. The fore plate 334 and the aft plate 336 each extend circumferentially about the axis 11. The aft plate 336 is spaced apart axially from the fore plate 334 to define a flow path 340 therebetween. The plurality of vanes 338 extend axially between and interconnect the fore plate 334 and the aft plate 336.

The fore plate 334 diverges axially relative to the aft plate 336 as the fore plate 334 and aft plate 336 extend radially outward relative to the axis 11 as shown in FIG. 11. The aft plate 336 extends radially parallel to a radial plane 350 of the axis 11.

The fore plate 334 includes a first segment 342 and a second segment 344 as shown in FIG. 11. The first segment 342 extends radially along the radial plane 350 of the axis 11, while the second segment 344 extends at an angle 352 from the first segment 342.

Figure 12:
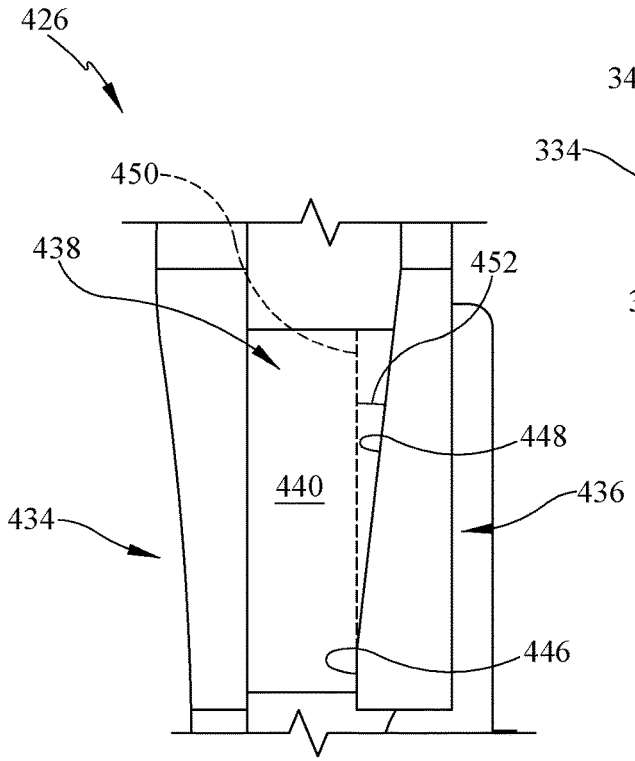
FIG. 12 is a cross-sectional view of another embodiment of a diffuser adapted for use in the centrifugal compressor included in the gas turbine engine of FIG. 1 showing that the fore plate extends radially and the aft plate diverges away from the fore plate as the plates extend radially outward.

Another embodiment of a diffuser 426 in accordance with the present disclosure is shown in FIG. 12. The diffuser 426 is substantially similar to the diffuser 26 shown in FIGS. 1-9 and described herein. Accordingly, similar reference numbers in the 400 series indicate features that are common between the diffuser 426 and the diffuser 26. The description of the diffuser 26 is incorporated by reference to apply to the diffuser 426, except in instances when it conflicts with the specific description and the drawings of the diffuser 426.

The diffuser 426 includes a fore plate 434, an aft plate 436, and a plurality of vanes 438 as shown in FIG. 12. The fore plate 434 and the aft plate 436 each extend circumferentially about the axis 11. The aft plate 436 is spaced apart axially from the fore plate 434 to define a flow path 440 therebetween. The plurality of vanes 438 extend axially between and interconnect the fore plate 434 and the aft plate 436.

The aft plate 436 diverges axially relative to the fore plate 434 as the fore plate 434 and aft plate 436 extend radially outward relative to the axis 11 as shown in FIG. 12. The fore plate 434 extends radially parallel to a radial plane 450 of the axis 11.

The aft plate 436 includes a first segment 446 and a second segment 448 as shown in FIG. 12. The first segment 446 extends radially along the radial plane 450 of the axis 11, while the second segment 448 extend at an angle 452 from the first segment 442.

The present disclosure relates to a diffuser 26, 226, 326, 426 or deswirler system that is adapted for use with a centrifugal impeller 24 in a centrifugal compressor 22. In some embodiments, the diffuser 26, 226, 326, 426 may be used in an axi-centrifugal compressor 14. In other embodiments, the diffuser 26, 226, 326, 426 may be used in any system with a centrifugal compressor 22.

The air exiting the impeller 24 may be at a high Mach number and dynamic pressure. In order to improve system efficiency and allow for stable combustion, the air may be slowed down, or diffused, with a static vane structure, or diffuser 26, 226, 326, 426, 526 before entering the combustor 16 of the gas turbine engine 10. The diffuser 26, 226, 326, 426 is a radial diffuser 26, 226, 326, 426 in the illustrative embodiment. In some embodiments, the centrifugal compressor 22 may also include a deswirler vane set that turns the flow path 40, 240, 340, 440 from radial to axial.

The radial diffuser 26, 226, 326, 426 includes a plurality of backswept vanes 38, 238, 338, 438 along with a diverging flow path 40, 240, 340, 440 from inlet 54 to exit 56. The combination of the backswept vanes 38, 238, 338, 438 and the diverging flow path 40, 240, 340, 440 may provide space claim and efficiency benefits compared to a typical diffuser that diffuses the air in the vane-to-vane sense.

In the illustrative embodiments, the throat exit 56 is radial. In other embodiments, the throat exit 56 may be carried into the turn of the deswirler.

As a result, the radial length of the diffuser 26, 226, 326, 426 may be shortened, while still maintaining the same overall diffusion as a conventional diffuser. Reducing the radial envelope of the diffuser 26, 226, 326, 426, without losing efficiency is advantageous to the engine design and installation.

The combination of the diverging fore and aft plates 34, 36, 234, 236, 334, 336, 434, 436 and the backswept vanes 38, 238, 338, 438 work together to diffuse the air through the diffuser 26, 226, 326, 426. The endwall diffusion reduces the radial velocity such that the swirl of the flow is naturally increased. By backsweeping the vanes 38, 238, 338, 438, the backswept vanes 38, 238, 338, 438 help the flow stay aligned with the vanes 38, 238, 338, 438 and attached to the surface in the presence of the diverging plates 34, 36, 234, 236, 334, 336, 434, 436.

Backsweeping the vanes 38, 238, 338, 438 in isolation may reduce losses, but may also give up static pressure recovery to the reduced overall area ratio. As a result, the endwall diffusion may be used to still get the same, or higher, diffuser area ratio in the same radial space envelope.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A diffuser adapted for use with a centrifugal compressor, the diffuser comprising a first plate that extends circumferentially about an axis, a second plate that extends circumferentially about the axis, the second plate spaced apart axially from the first plate relative to the axis to define a flow path between the first plate and the second plate, and a plurality of vanes that extend axially between and interconnect the first plate and the second plate, the plurality of vanes including a first vane and a second vane spaced apart circumferentially from the first vane to define a throat inlet of the diffuser located at a radial throat distance from the axis, the first vane and the second vane each including a leading edge and a trailing edge spaced apart radially from the leading edge to define a camber line that extends within the respective first and second vane and interconnects the leading edge and the trailing edge of the respective first and second vane, wherein the plurality of vanes are backswept such that the camber line of each of the first vane and the second vane is curved, the radial throat distance is spaced radially outward of the leading edges of the first and second vanes, and at least one of the first plate and the second plate diverges axially relative to the other of the first plate and the second plate beginning at a location equal to the radial throat distance or radially outward of the radial throat distance.

2. The diffuser of claim 1, wherein both the first plate and the second plate diverge axially away from the other of the first plate and the second plate as the first plate and the second plate extend radially outward relative to the axis.

3. The diffuser of claim 2, wherein the first plate and the second plate diverge linearly away from the other of the first plate and the second plate.

4. The diffuser of claim 3, wherein each of the plurality of vanes defines a chord line between the leading edge and the trailing edge and the chord line extends at an angle relative to a radial spoke line extending from the axis.

5. The diffuser of claim 1, wherein the first plate has a first segment that extends radially and a second segment that extends at an angle from the first segment.

6. The diffuser of claim 1, wherein each of the plurality of vanes includes a pressure side and a suction side opposite the pressure side and wherein at least one of the pressure side and the suction side includes a concave surface that extends circumferentially into the respective vane and extends axially between and interconnects the first plate and the second plate.

7. The diffuser of claim 1, wherein each of the plurality of vanes includes a pressure side and a suction side opposite the pressure side and wherein the pressure side and the suction side each include a concave surface that extends circumferentially into the respective vane and extends axially between and interconnects the first plate and the second plate.

8. The diffuser of claim 1, wherein the first vane and the second vane of the plurality of vanes define a throat exit spaced apart from the throat inlet that has a throat exit area that is greater than a throat inlet area of the throat inlet.

9. The diffuser of claim 1, wherein each of the plurality of vanes defines a chord line that extends linearly a chord-line distance between and interconnects the leading edge and the trailing edge, the camber line is curved relative to the chord line to define a maximum camber-line height between the camber line and the chord line, and the camber-line height is equal to or less than one to ten percent of the chord-line distance.

10. The diffuser of claim 1, wherein a first line tangent to the leading edge of the first vane and a first radial spoke from the axis extending to the leading edge define a first angle, a second line tangent to the trailing edge of the first vane and a second spoke from the axis extending to the trailing edge define a second angle, and a difference between the first angle and the second angle is 15 degrees.

11. The diffuser of claim 1, wherein the at least one of the first plate and the second plate diverge away from a radial plane of the axis at a divergence angle of 5 degrees.

12. A diffuser adapted for use with a centrifugal compressor, the diffuser comprising a first plate that extends circumferentially about an axis, a second plate that extends circumferentially about the axis, the second plate spaced apart axially from the first plate relative to the axis, and a first vane having a first camber line that extends between and interconnects a leading edge and a trailing edge of the first vane, and a second vane spaced apart circumferentially from the first vane, the second vane having a second camber line that extends between and interconnects a leading edge and a trailing edge of the second vane, wherein the first camber line and the second camber line are curved and the first plate and the second plate cooperate to define a flowpath that diverges axially as the first plate and the second plate extend radially outward relative to the axis, and wherein the first vane and the second vane define a throat inlet of the diffuser located at a radial throat distance from the axis, the flowpath diverges axially beginning at a location equal to or radially outward of the radial throat distance, and the radial throat distance is spaced radially outward of the leading edges of the first and second vanes.

13. The diffuser of claim 12, wherein both the first plate and the second plate diverge axially away from each other as the first plate and the second plate extend radially outward relative to the axis.

14. The diffuser of claim 13, wherein the first plate and the second plate diverge linearly away from each other.

15. The diffuser of claim 12, wherein the first vane defines a chord line that extends linearly a chord-line distance between and interconnects the leading edge and the trailing edge of the first vane, the camber line of the first vane is curved relative to the chord line to define a maximum camber-line height between the camber line and the chord line of the first vane, and the camber-line height is equal to or less than two percent of the chord-line distance.

16. The diffuser of claim 12, wherein the first vane extends circumferentially away from the axis at a first angle relative to a first radial spoke of the axis at the leading edge and extends circumferentially away from the axis at a second angle relative to a second radial spoke of the axis at the trailing edge, and the difference between the first angle and the second angle is 15 degrees.

17. The diffuser of claim 12, wherein the flowpath diverges axially as the first plate and the second plate extend radially outward relative to the axis between at an angle of between about 1 degree and 10 degrees.

18. The diffuser of claim 17, wherein the angle is 5 degrees.

19. The diffuser of claim 12, wherein the first vane includes a first side and a second side spaced apart circumferentially from the first side and wherein at least one of the first side and the second side defines a concave shape that extends circumferentially into the first vane.

* * * * *